US005149214A

United States Patent [19]

Futagawa et al.

[11] Patent Number: 5,149,214

[45] Date of Patent: Sep. 22, 1992

[54] PRINT WIRE DRIVING APPARATUS

[75] Inventors: Yoshikiya Futagawa; Katsuhiko Nishizawa, both of Suwa, Japan

[73] Assignee: Seiko Epson Corporation, Tokyo, Japan

[21] Appl. No.: 450,137

[22] Filed: Dec. 13, 1989

[30] Foreign Application Priority Data

Dec. 13, 1988 [JP] Japan ..... 63-314262
May 18, 1989 [JP] Japan ..... 1-124746

[51] Int. Cl.[5] ..... B41J 9/38
[52] U.S. Cl. ..... 400/157.2; 361/152
[58] Field of Search ..... 400/157.2, 157.3, 166, 400/167; 361/152-159

[56] References Cited

U.S. PATENT DOCUMENTS

| | | | |
|---|---|---|---|
| 3,488,519 | 1/1970 | Vadrot | 400/121 |
| 3,560,803 | 2/1971 | Shih | 361/152 |
| 4,027,761 | 6/1977 | Quaif | 400/121 |
| 4,323,944 | 4/1982 | Hill | 361/152 |
| 4,396,304 | 8/1983 | Davenport | 400/124 |
| 4,454,558 | 6/1984 | Haddart | 361/153 |
| 4,621,299 | 11/1986 | Hill | 361/155 |
| 4,637,742 | 1/1987 | Sakai | 400/157.2 |
| 4,661,882 | 4/1987 | Gresley | 361/159 |
| 4,667,117 | 5/1987 | Nebgen et al. | 400/157.3 |
| 4,679,116 | 7/1987 | Oshizawa | 361/154 |
| 4,741,636 | 5/1988 | Takahashi et al. | 400/157.3 |
| 4,835,655 | 5/1989 | Ricci | 400/157.2 |
| 4,866,564 | 9/1989 | Aoki | 361/159 |
| 4,868,709 | 9/1989 | Aoki | 361/159 |

FOREIGN PATENT DOCUMENTS

| | | | |
|---|---|---|---|
| 2240533 | 3/1975 | France | 361/152 |
| 17782 | 1/1986 | Japan | 400/157.2 |
| 161549 | 7/1987 | Japan | 400/157.2 |

*Primary Examiner*—David A. Wiecking
*Assistant Examiner*—Steven S. Kelley
*Attorney, Agent, or Firm*—Blum Kaplan

[57] ABSTRACT

A print wire driving apparatus for use in a printer having a stabilized power source, a print wire, an urging coil for driving said print wire and a power source including a smoothing capacitor for energizing the urging coil is provided. An accumulating circuit accumulates electro-magnetic energy generated in the urging coil once the current supplied to the urging coil has been turned OFF. A feedback circuit feeds back energy from the accumulating circuit to the smoothing capacitor when the voltage of the accumulating circuit reaches a predetermined level. A regulating circuit maintains the voltage of the accumulating circuit so that the voltage does not fall below the predetermined level, thereby obtaining high power source efficiency and high speed operation of the print wire.

14 Claims, 6 Drawing Sheets

FIG.6
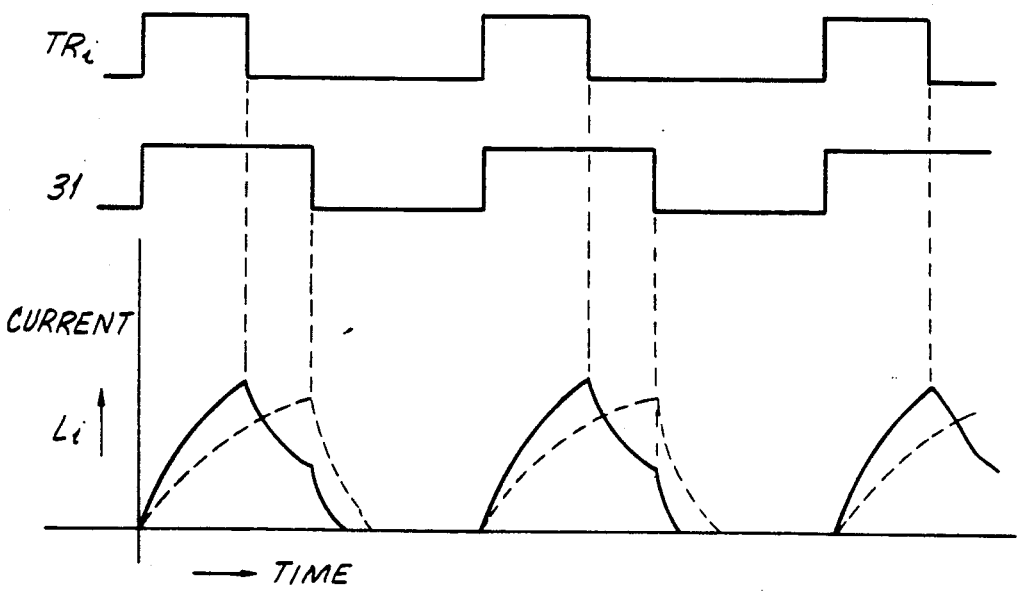
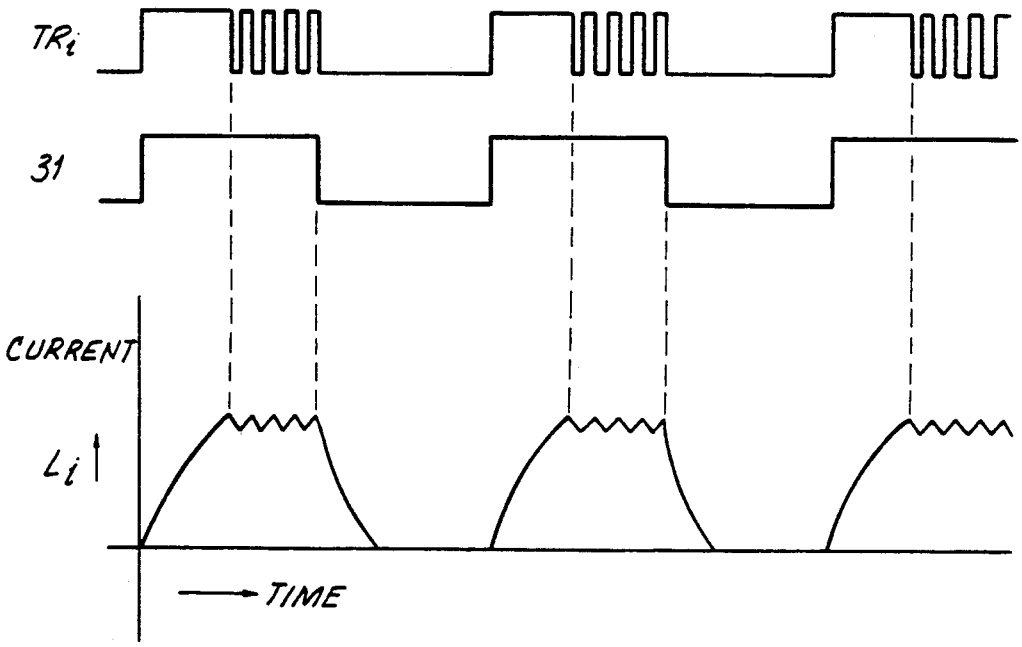
FIG.7

PRINT WIRE DRIVING APPARATUS

BACKGROUND OF THE INVENTION

The present invention relates to a print wire driving apparatus, and more particularly to an apparatus for improving power supply efficiency in driving print wire.

Wire dot print heads and print wire drivers are well known in the art. A conventional wire dot print head, shown in FIG. 12 includes a core 12 having urging coils 11 wound thereabout. A plurality of wires 14 are supported on springs 13 for selectively extending the portions of wires 14 beyond the nose of wire dot print head 10. Urging coils 11 are energized to attract springs 13 which in turn impart kinetic energy to wires 14. This causes wires 14 to extend through wire dot print head 10 to strike an ink ribbon forming characters or figures in the form of a dot matrix. Wire dot print head 10 may include eight to sixty-four wires 14 depending on the use to which the printer is to be applied.

Reference is now made to FIG. 9 in which a conventional apparatus for driving wire dot print head 10, generally indicated as 20, is provided. Apparatus 20 includes a power source 2, a drive circuit 5 coupled to power source 2 and a drive signal generator 6 also coupled to drive circuit 5. Power source 2 includes a pair of input terminals 1 and 1' which are coupled to a voltage source. A capacitor $C_0$ and a stabilizing circuit 3 are in parallel and connected across input terminals 1 and 1'. A diode PD is connected to input terminal 1' and to a first terminal A. The output of stabilizing circuit 3 is electrically connected to terminal A. A smoothing capacitor $C_1$ is electrically coupled to input terminal 1' and a first terminal B. A smoothing inductor PL is electrically coupled between terminal A and terminal B.

Power source 2 emits a stabilized voltage through feedback of the voltage across terminal B to stabilizing circuit 3 along an input 4. Diode PD is designed so that stabilizing circuit 3 allows current to follow in a gated manner in accordance with the electromagnetic energy accumulated in smoothing inductor PL to charge smoothing capacitor $C_1$.

Drive signal generator 6 includes a shift register 9 which sequentially store input data corresponding to the characters of figures to be printed under the control of the input from a shift clock. A latch circuit 8 simultaneously latches the data accumulated in shift register 9 in response to input latch pulses. An enable circuit 7 restricts the time period in which latch circuit 8 provides an output in response to an input enable signal. Driving signal generator 6 supplies data which is adapted for use by print head 10 to drive circuit 5.

Drive circuit 5 includes a plurality of urging coils $L_i$, transistors $TR_i$ and diodes $D_i$. For simplicity, a single grouping of these elements is described. An urging coil $L_1$ is coupled between a first terminal 1 and one end of an N type transistor $TR_1$ having its gate coupled to enable circuit 7 and its other end coupled to input terminal 1'. The anode and cathode of a diode $D_1$ are coupled at an end of urging coil $L_1$ and a zener diode ZD, respectively. Each of the diodes $D_1$ and $D_i$ are connected to a single zener diode ZD. The number i corresponds to the number of print wires 14 contained within print head 10.

Reference is now made to FIGS. 10*a* and 10*b* in which equivalent circuits generally indicated as 100*a*, 100*b* of respective prior art apparatus 20 are shown in which it is assumed that a voltage $V_1$ at terminal B equals 30 V. The inductance of urging coil $L_i$ is set at $L=3$ mH and has a resistance $R_L=20\Omega$. The equivalent resistance of transistor $TR_i$, $R_T$, is set at 0.5 Ω and the equivalent voltage $V_Z$ of zener diode ZD is set at 75 volts and has an equivalent resistance $R_Z$ of 0.5 Ω. Equivalent circuit 100*a* is the circuit resulting when transistor $TR_i$ is ON and circuit 100*b* illustrates a case in which transistor $TR_i$ is OFF.

The current $i_1$ of equivalent circuit 100*a* can be expressed as follows:

$$\begin{aligned} i_i &= E/(R_L + R_T)\cdot\{1 - \exp(-t/\tau_0)\} \\ &= 1.463\{1 - \exp(-t/\tau_0)\} \end{aligned}$$

where $$\begin{aligned} \tau_0 &= 3\times 10^{-3}/(20 + 0.5) \\ &= 1.463\times 10^{-4}\ \text{sec.}, \end{aligned}$$

and t is time.

To calculate the energy of the system, the period of time in which transistor $TR_i$ is ON is assumed to be 200 μs. Energy $P_{IN1}$ supplied by power source 2 is expressed as follows:

$$\begin{aligned} P_{IN1} &= \int_o^{200\ \mu s} 30\cdot i_1 dt \\ &= 3.99\ \text{mJ (joules)} \end{aligned}$$

The energy consumed due to the resistance of equivalent circuit 100*a* having a total resistance of 20.5 Ω is expressed as follows:

$$\begin{aligned} P_{R1} &= \int_o^{200\ \mu s} 20.5\cdot i_i^2 dt \\ &= 2.21\ \text{mJ (joules)} \end{aligned}$$

The energy $P_L$ accumulated within urging coil $L_i$ is:

$$\begin{aligned} P_L &= \tfrac{1}{2}\cdot L\cdot i_1^2 \\ &= 1.78\ \text{mJ} \end{aligned}$$

The foregoing equations may be checked based on the conservation of energy so that the power supplied by the power source should equal the energy consumed by the resistor and the energy accumulated by the coil. Accordingly, it follows that:

$$\begin{aligned} P_{IN1} &= P_{R1} + P_L \\ &= 2.21\ \text{mJ} + 1.78\ \text{mJ} \\ &= 3.99\ \text{mJ}. \end{aligned}$$

Reference is now made to FIG. 10*b* and equivalent circuit 100*b* which represents apparatus 20 when transistor $TR_i$ is OFF. If the current $i_2$ is determined based upon the following underlying assumptions that:

$$\text{when } t = 0,\ i_{20} = i_{1200\mu s} = 1.99\ A$$

$$\text{and when } t = \infty,\ i_{2\infty} = (30 - 75)/20.5 = -2.2\ A$$

-continued then $i_2 = 3.29 \exp(-t/\tau_0) - 2.2.$

If time $\tau$ when $i_2=0$ is determined, then $\tau=5.88\times10^{-5}$ sec.

Reference is now made FIG. 11 wherein the currents $i_1$, $i_2$ derived above are graphically displayed. A maximum cycle period of 500 $\mu$s is illustrated to provide a time cushion between ensuing operation of the urging coil. The time cushion is required since vibrations that are not directly related to striking occur after print wire 14 has struck an ink ribbon until print wire 14 returns to its original stationary position. The energy produced and utilized during the time period 0 to $\tau$, corresponding to the production of current $i_2$ is calculated by first calculating energy $P_{IN2}$ supplied by power source 2.

$$P_{IN2} = \int_0^{\tau} 30 \cdot i_2 dt = 0.9 \text{ mJ}$$

The energy $P_{R2}$ consumed by the overall resistance of equivalent circuit 100*b* having a value of 20.5 Ω is:

$$P_{R2} = \int_0^{\tau} 20.5 + i_2^2 dt = 0.43 \text{ mJ}$$

The energy $P_{ZD}$ consumed which is attributable to the equivalent voltage of the zener diode ZD is expressed as follows:

$$P_{ZD} = \int_0^{\tau} 75 i_2 dt = 2.25 \text{ mJ}$$

The energy consumed which is attributable to the 0.5 Ω resistance of zener diode ZD is expressed as follows:

$$P_{RZ} = 0.43\ (0.5/20.5) = 0.01 \text{ mJ}$$

Therefore, total energy consumed by zener diode ZD is expressed as follows:

$$P_{TZD}=2.25+0.01=2.26\ mJ.$$

The total energy $P_{IN}$ supplied by power source may be expressed as follows:

$$P_{IN} = P_{IN1} + P_{IN2} = 3.99 + 0.9 = 4.89 \text{ mJ}$$

Accordingly, the energy consumed by zener diode ZD which is equal to 2.26 J accounts for as much as 46% of the energy supplied by power source 2. Zener diode ZD is required by apparatus 20 to quickly cut off current $i_2$ to operate print wires 14 at a high speed. The higher the voltage of zener diode ZD, the more quickly current $i_2$ can be cut off.

In the actual prior art device, assuming that the number of dot wires is 24 and that the repetition frequency is 2 kHz, the power P supplied by power source 2 is expressed as follows:

$$P = 4.89 \times 10^{-3} \times 24 \times 2 \times 10^3 = 235\ W$$

The actual power consumption $P_Z$ of zener diode ZD is expressed as follows:

$$P_Z = 2.26 \times 10^{-3} \times 24 \times 2 \times 10^3 = 108\ W.$$

As can be seen, roughly 46% of the power utilized by the system is consumed by the zener diode.

Most of the energy supplied by the power source in apparatus 20 is consumed by the resistance of the urging coils and zener diode resulting in a large conversion of energy into heat. As the number of print wires and operating speed increases, design of a print head which satisfactorily reduces energy lost through heat becomes more difficult. Furthermore, as the number of print wires increase a large capacity power source which can instantly supply the power must be utilized since the coils are simultaneously energized.

Accordingly, it is desirable to provide an apparatus for driving a wire dot print head which overcomes the shortcomings of the prior art by efficiently utilizing the energy supplied by the power source.

SUMMARY OF THE INVENTION

Generally speaking, in accordance with the invention, an apparatus for driving a print wire having a stabilized power source is provided. The power source includes a smoothing capacitor which energizes an urging coil causing the print wire to move. The power source includes an accumulating circuit for accumulating electromagnetic energy produced in the urging coil once current supplied to the urging coil has been discontinued. A maintaining circuit maintains the voltage level of the accumulator so that the voltage level does not fall below a predetermined level and a feed back circuit returns the accumulated energy to the smoothing capacitor when the voltage level of the accumulating circuit reaches the predetermined level so that the voltage of the accumulator is controlled to remain at a substantially fixed level.

The feed back circuit includes a first detector for detecting whether the voltage of the accumulating circuit is at the predetermined level or higher. A first switch which is switched in response to a signal from the first detection circuit is coupled to the accumulating circuit so that the excess energy of the accumulating circuit is fed back to the smoothing capacitor through a smoothing inductor.

Another embodiment replaces the smoothing inductor with a second inductor. The maintaining circuit includes a second detector for detecting whether the voltage of the accumulating circuit is at the predetermined level or higher. A second switch is switched in response to a signal from the second detector and a signal from a predetermined clock. The second switch and the second inductor are connected to each other in series. A diode is disposed between the injunction of the second switch and the second inductor and the accumulator to prevent the voltage from falling below the predetermined level.

In another embodiment of the invention, a diode is incorporated in the first switch and second switch and the second inductor is commonly used to provide the feed back of the excess energy of the accumulating circuit to the smoothing capacitor as well as to maintain the voltage level of the accumulating circuit.

The driving apparatus for exciting the urging coil and the drive signal generator which produces a predetermined signal to the driving circuit are mounted on the same carriage on which the print wire is mounted. This reduces the number of cables required to communicate between the carriage and the number of signal lines.

Accordingly, it is an object of the invention to provide an improved apparatus for driving a print wire.

Another object of the invention of the invention is to provide an apparatus for driving a print wire in which the electromagnetic energy accumulated in the urging coils is temporarily accumulated in an accumulating circuit and then fed back to the power source to reduce the load on the power source and to provide high speed operation at a higher efficiency.

Yet another object of the invention is to provide an apparatus for driving a print wire which minimizes the number of elements required to provide high speed operation of the print wire while maintaining high efficiency.

Yet another object of the invention is to provide an apparatus for driving a print wire in which the voltage of the accumulating circuit can be controlled to remain at a substantially fixed level due to the inter-cooperation of component elements.

Still another object of the invention is to provide an apparatus for driving a print wire which reduces an amount of power consumed by preventing as much as 46% of the electro-magnetic energy from being converted into heat.

Still other objects and advantages of the invention will in part be obvious and will in part be apparent from the specification.

The invention accordingly comprises the features of construction, combinations of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 6 are waveform diagrams of the transistors and urging coil of FIG. 5;

FIG. 7 are waveform diagrams of the transistor and urging coil of the circuit of FIG. 5;

DETAILED DESCRIPTION OF THE PREFERRED EMBODIMENTS

Figure 1:
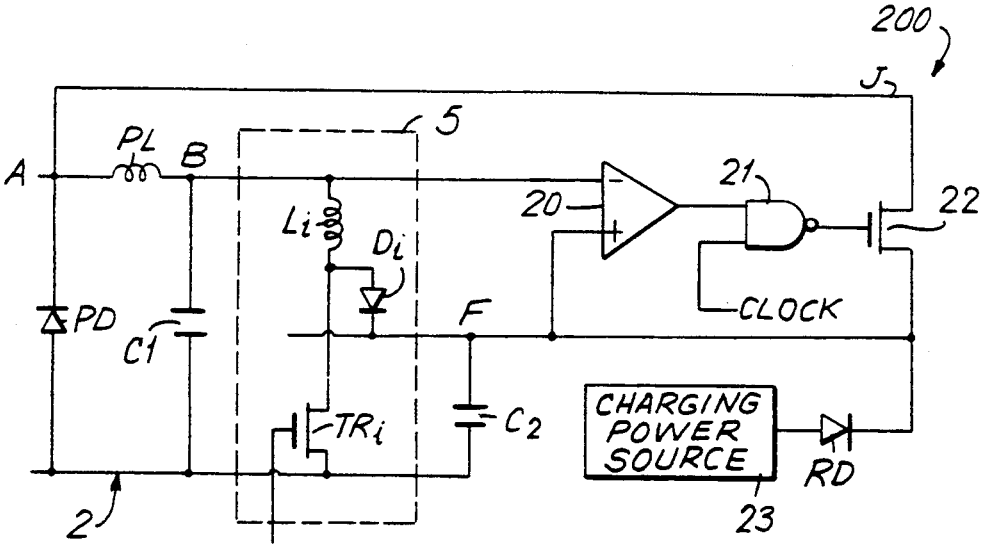
FIG. 1 is a schematic diagram of an apparatus for driving a print wire constructed in accordance with a first embodiment of the invention.

Reference is now made to FIG. 1 in which a schematic diagram of an apparatus for driving a print wire, generally indicated as 200, constructed in accordance with the invention is provided. Apparatus 200 includes a power source 2 and a driving circuit 5. For simplicity, only a portion of power source 2 and only a driving mechanism for a single print wire is illustrated. Wire driving apparatus 200 is similar in construction to apparatus 20. However, zener diode ZD is replaced by a second capacitor $C_2$ coupled to drive circuit 5.

As in apparatus 20, power source 2 of apparatus 200 includes a first capacitor $C_1$ connected in series with a smoothing inductor PL which together are connected in parallel with a diode PD. Inductor PL is connected to capacitor $C_1$ at a junction B and to one end of diode PD at a junction A.

Drive circuit 5 includes an urging coil $L_i$. A first end of coil $L_1$ is coupled in series with a diode $D_i$ and N type transistor $TR_i$ as in apparatus 20.

Second capacitor $C_2$ is in parallel with transistor $TR_i$ and connected at a junction F to the cathode of diode $D_i$ and the positive (noninverting) input of a comparator 20. The negative (inverting) input of comparator 20 is coupled at junction B to a second end of urging coil $L_i$. A NAND gate 21 receives the output of comparator 20 as a first input and a clock signal as a second input and provides an output to the gate of P type transistor 22. One end of a transistor 22 is coupled to junction A through a connector J. The other end of transistor 22 is connected at junction F to the positive input of comparator 20 and the cathode of diode RD. The anode of diode RD is connected to the output of a charging power source 23.

When transistor $TR_1$ is turned OFF, the electro-magnetic energy accumulated in urging coil $L_i$ flows through diode $D_i$ and is stored in capacitor $C_2$. The voltage at junction F increases each time urging coil $L_i$ is energized. Comparator 20 detects voltage $V_h$ at junction F and provides a high logic level whenever the detected voltage is equal to or greater than a predetermined level, such as 75 volts.

NAND gate 21 gates the output of comparator 20 in response to the input from the clock providing an intermittent signal which intermittently switches transistor 22 ON. This causes the excess energy stored in capacitor $C_2$ occurring at level $V_h$ (75 V) or above to be transferred to capacitor $C_1$ through connection J and inductor PL. The current flowing through inductor PL when transistor 22 is in an OFF state is re-routed by diode PD to charge capacitor $C_1$. This allows the excess energy stored within capacitor $C_2$ to efficiently be transferred to capacitor $C_1$. Charging power source 23 charges capacitor $C_2$ through diode RD so that voltage $V_h$ of capacitor $C_2$ does not fall below a second predetermined level, for example 72 V (but not greater than 75 V). Charging power source 23 is provided because no current is supplied to capacitor $C_2$ for a predetermined time period after power source 2 has been turned ON or during a non-printing period when all urging coils $L_i$ are inoperative.

Capacitor $C_2$ becomes operative without the use of a zener diode. Therefore, it becomes necessary for the voltage to be stabilized at the predetermined level $V_h$ (75 V in this embodiment). If this voltage becomes unstable, the current termination period of the current flowing through urging coil $L_i$ after transistor $TR_i$ is turned OFF becomes unstable. It then becomes impossible to provide a stable high speed print wire driving operation. A voltage of charging power source 23 is set at 72 volts because the target voltage $V_h$ of capacitor $C_2$ is set at 75 V. The power consumption of charging power source 23 is reduced by isolating the same (i.e., an insulated state) through diode RD during operation of apparatus 200. This makes it possible to use a compact small capacity charging power source 23.

Figure 2A:
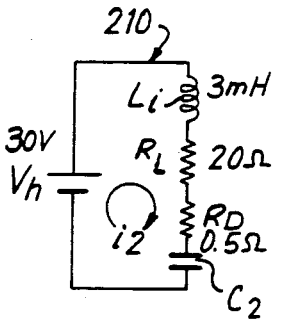
FIGS. 2*a*–2*c* are circuit diagrams of equivalent circuits illustrating operation of the circuit of FIG. 1.
Figure 2B:
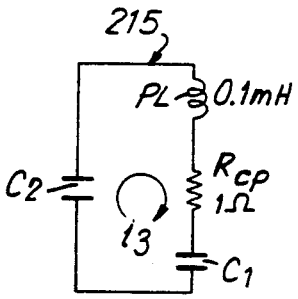
Figure 2C:
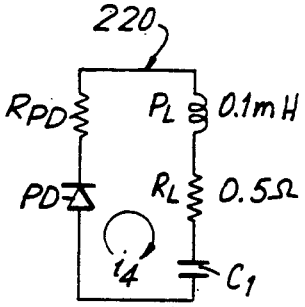

Reference is now made to FIGS. 2a–2c in which equivalent circuits, 210 (FIG. 2a), 215 (FIG. 2b) and 220 (FIG. 2c) illustrate the operation of driving apparatus 200. In each of the equivalent circuits, it is assumed that the ON period of transistor $TR_i$ is identical to that in driving apparatus 20 and that the current $i_1$ is also identical.

Equivalent circuit 210 illustrates the current flow from urging coil $L_i$ through capacitor $C_2$ when transistor $TR_i$ is turned OFF. The equivalent circuit 215 illustrates current flow from capacitor $C_2$ to capacitor $C_1$ when no current flows from power source 2. The equivalent circuit 220 illustrates operation of apparatus 200 when transistor 22 is turned OFF.

In circuit 210, once transistor $TR_i$ has been turned OFF the equivalent coil for urging coil $L_i$ has a value of 3 mH and a resistance $R_L$ of 20Ω. Resistance $R_D$ of diode $D_i$ is 0.5Ω. The capacitance of capacitor $C_2$ is 1,000 μF. When t=0, $i_{20}$ is equal to 1.94 A. The voltage of $V_h$ of capacitor $C_2$ equals 75 V. When $\epsilon=28$, $i_{28}=0$ and $V_h+30$ V. If the current $i_2$ is determined under these conditions, the current may be expressed as follows:

$$i_2=3.33\ exp\ (-6.78\times10^3t)\ -2.24\ exp\ (-4.91\times10t)$$

The time $\tau$ required to arrive at the condition $i_2=0$ has a value of $5.9\times10^{-5}$ s. The energy produced and consumed within this time period can be determined as follows wherein the energy $P_{IN2}$ supplied by power source 2 may be represented as:

$$P_{IN2} = \int_o^\tau 30\cdot i_2 dt = 0.9\ \text{mJ}$$

The energy $P_{R2}$ consumed by the total resistance of the equivalent circuit, 20.5 Ω may be calculated as follows:

$$P_{R2} = \int_o^\tau 20.5 - i_2^2 dt = 0.43\ \text{mJ}$$

The increase in the charge Q of capacitor $C_2$ can be calculated as follows:

$$Q = \int_o^\tau i_2 dt = 2.99\times10^{-5}\ \text{coulomb}$$

A rise in the corresponding voltage becomes $2.99\times10^{-2}$ V. Accordingly, an increase in energy $\Delta P_{C2}$ of capacitor $C_2$ may be represented as follows:

$$P_{C2} = \tfrac{1}{2}\times10^{-3}F\cdot(75.0299^2-75^2) = 2.24\ \text{mJ}$$

Accordingly, $$\begin{aligned} P_{IN2}+\tfrac{1}{2}L\cdot i_{20}^2 &= 0.9+1.78 \\ &= 2.68\ \text{mJ} \\ &= P_{R2}+P_{C2} \\ &= 0.43+2.24 \\ &= 2.67\ \text{mJ} \end{aligned}$$

Therefore, it follows that 83.5% (2.24 mJ/2.68 mJ) of the energy across is transferred to capacitor $C_2$.

Referring to circuit 215, the operation of apparatus 200 is illustrated at a moment in time when the increased energy of capacitor $C_2$ is fed back to capacitor $C_1$. It is assumed that capacitor $C_1$ has a capacitance of 5,000 μF and that transistor 22 and inductor PL have a combined equivalent resistance of 1Ω. It is also assumed that capacitor $C_1$ has been charged to 30 volts.

When t=0, $i_3=0$ and the charge of capacitor $C_1$ is as follows:

$$Q_{C10} = 30\ V\times5\times10^{-3} = 0.15\ \text{coulombs}$$

while the charge of capacitor $C_2$ is $75.0299\times10^{-3}$ coulombs. On the other hand, when $t=\infty$, $i_3=0$, $Q_{C1\infty}=0.18752491$ coulombs, $Q/_{C2\infty}=3.750498\times10^{-2}$ coulombs. If the differential equation is solved as above, we arrive at:

$$i_3=62.4\ \}exp\ (-8.61\times10^3t)-exp\ (-1.39\times10^3t)\}$$

$$V_h=-7.25\ \text{exp}\ (-8.61\times10^3t)+44.8\ exp\ (-1.39\times10^3t)+37.5$$

When the value for $V_h$ shifts from 75.0299 V to 75 V, comparator 20 does not provide an output (i.e., a high logic level) resulting in transistor 22 being turned OFF.

Time $\tau$ has a value of $1.07\times10^{-5}$ sec. The current $i_3$ at this time is 4.57 A. Therefore, the energy $P_R$ consumed which is attributable to the 1Ω resistance of the equivalent circuit may be expressed:

$$P_R = \int_o^\tau 1 \cdot i_3^2 dt$$
$$= 0.8 \text{ mJ}$$

Electro-magnetic energy may be expressed $$\tfrac{1}{2} L i_3^2 \tau = 1.05 \text{ mJ}$$

wherein an increase in energy $\Delta P_{C11}$ of capacitor $C_1$ is 0.90 mJ.

The increase in energy $\Delta P_{C2}$ of capacitor $C_2$ changes to:

$$P_R + \tfrac{1}{2} L i_3^2 \tau + \Delta P_{C1} = 0.08 + 1.05 + 0.9$$
$$= 2.03 \text{ mJ}$$

The incremental energy stored in capacitor $C_2$ of 2.24 mJ when transistor $TR_i$ is turned OFF is now 2.03 mJ when no current flows from power source 2, that is, a calculational difference of 0.21 mJ. The difference in energy is assumed to have been consumed by the resistance of the circuit.

Reference is now made to equivalent circuit 220 in which transistor 22 has been turned OFF. Current $i_4$ and the time $\tau$ when current $i_4$ is turned off may be determined as follows:

$$i_4 = 35.95 \exp(-9.8 \times 10^3 t) - 31.38 \exp(-2.04 \times 10^2 t)$$

$$\tau = 1.42 \times 10^{-5} s$$

With the above information, it may be determined that the increase in energy $\Delta P_{C12}$ of capacitor C is equal to 0.95 mJ. The electro-magnetic energy of circuit 215 changes from 1.05 mJ by an amount $P_{C12}$ equal to 0.95 mJ. The amount of energy consumed by the resistance of Circuit 220 is 0.95 mJ.

Figure 3:
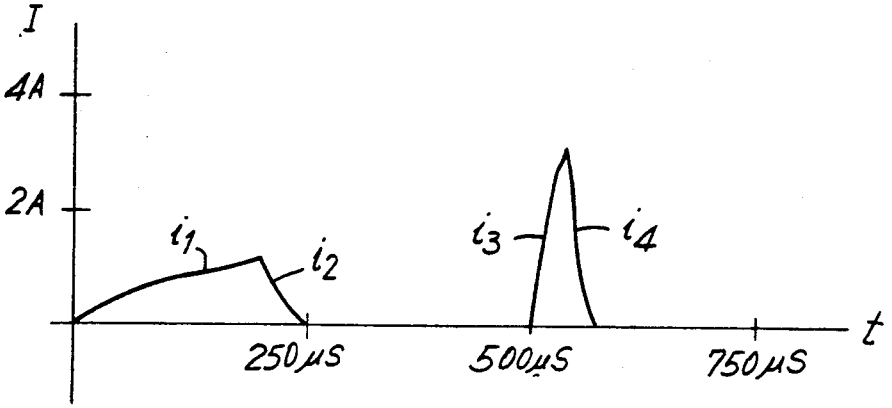
FIG. 3 is a graphical representation of the currents flowing in the equivalent circuits of FIG. 2.

Reference is now made to FIG. 3 in which currents $i_2$, $i_3$ and $i_4$ of circuit 210, 215, 220, respectively, and current $i_1$ of apparatus 200 are graphically represented. If the peaks of currents $i_3$ and $i_4$ are greater than the peaks of currents i1 and $i_2$, assembly of apparatus 200 becomes difficult. Accordingly, an output of comparator 22 is turned ON and OFF, i.e., gated by NAND gate 21 based on a clock input to allow transistor 22 to be repeatedly turned ON and OFF. This makes currents $i_3$ and $i_4$ small and extends the energy transmission time as well as improving transmission efficiency as will be described in detail.

The energy supplied by power source 2, $P_{IN1}+P_{IN2}$ is 4.89 mJ. The energy fed back to capacitor $C_1$, $\Delta P_{C11}+\Delta P_{C12}$ is equal to 1.85 (i.e., 0.90+0.95) mJ. The energy recovery rate increases to 37.8% (1.85/4,.9). The remaining 62.2% of energy is primarily consumed by the system resistance and for driving the print wire.

Figure 4:
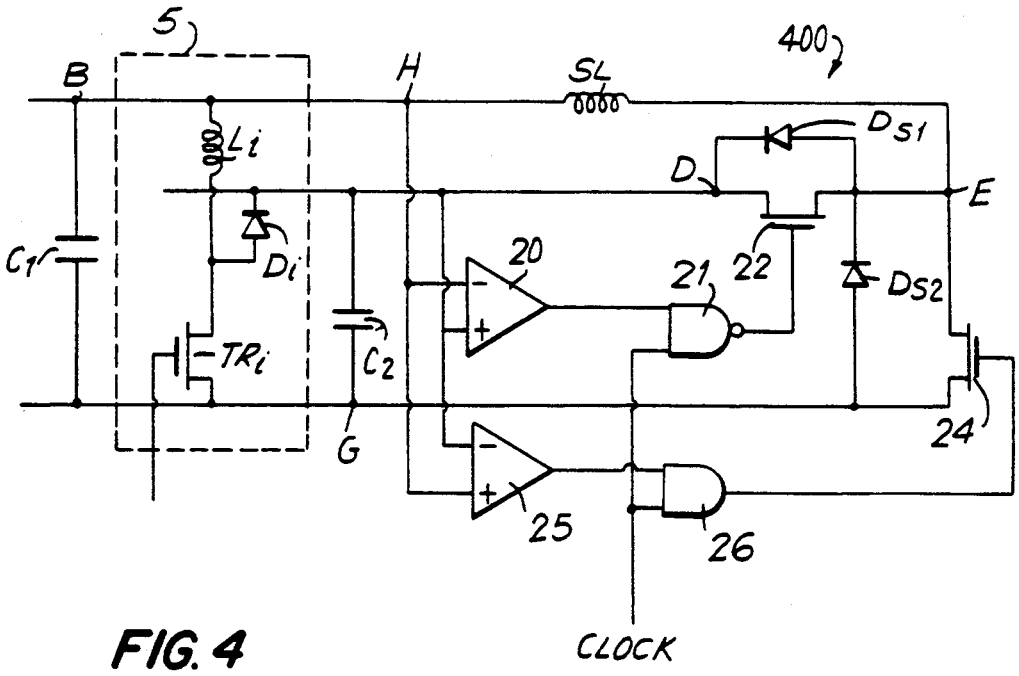
FIG. 4 is a circuit diagram of an apparatus for driving a print wire in accordance with a second embodiment of the invention.

Reference is now made to FIG. 4 wherein an apparatus for driving a print wire, generally indicated as 400, constructed in accordance with another embodiment of the invention is provided. An inductor SL is substituted for smoothing inductor PL in the energy feed back loop. Additionally, charging power source 23 is removed.

Specifically, apparatus 400 includes a drive circuit 5 identical to that in apparatus 200. A capacitor $C_1$ is coupled in parallel to drive circuit 5, while a second capacitor $C_2$ is coupled between the cathode of a diode $D_i$ at a junction D and one end of transistor $TR_i$ at a junction G. A comparator 20 again has its negative input coupled at a junction H between one end of urging coil $L_i$ and inductor SL. The positive input of comparator 20 is connected to the cathode of diode $D_i$ at junction D. A NAND gate 21 receives the outputs from comparator 20 and a clock and provides a gated signal output to the gate of transistor 22.

Apparatus 400 also differs from apparatus 200 in that a diode $D_{S1}$ is in parallel with transistor 22; between junction D and a junction E; the anode being connected to junction E and the cathode being connected to junction D. An N type transistor 24 is coupled at its gate to the output of an AND gate 26 and at its ends, to inductor SL at junction E and to capacitor $C_2$ at junction G. A second diode $D_{S2}$ is coupled across transistor 24 between junctions E and G with the cathode of diode $D_{S2}$ and anode of diode $D_{S1}$ coupled together. The negative input of a comparator 25 is connected to diode D at junction D, the positive input of comparator 25 connected to junction H. The output of comparator 21 provides a first input to AND gate 26. AND gate 26 receives a second input from the same clock signal as provided to NAND gate 21.

In the energy feedback loop of apparatus 400, smoothing inductor PL is replaced by inductor SL and diode PD is replaced by diode $D_{S2}$. However, there is substantially no difference in operation of the apparatus. To charge capacitor $C_2$, comparator 25 provides an output when the charging voltage $V_h$ of capacitor $C_2$ at junction D reaches a level 72 V in the same manner as described above in connection with charging power source 23. An AND gate 26 gates the output of comparator 25 in response to the clock input to intermittently turn transistor 24 ON. In this way, an ON/OFF current is delivered to inductor SL. When transistor 24 is turned OFF, the electro-magnetic energy of inductor SL charges capacitor $C_2$ through diode $D_{S1}$. When the charging voltage exceeds 72 V, comparator 20 stops producing an output signal thereby stopping the charging operation. An effective charging power source having a simplified design results.

Figure 5:
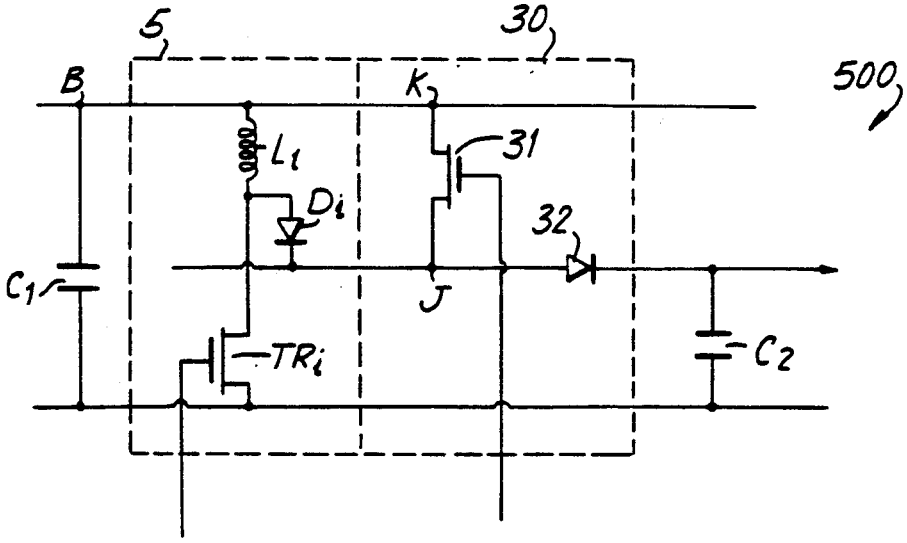
FIG. 5 is a circuit diagram of an apparatus for driving a print wire constructed in accordance with a third embodiment of the invention.

Reference is now made to FIG. 5 in which a drive circuit, generally indicated as 500 constructed in accordance with another embodiment of the invention is provided. Drive circuit 500 is similar to drive circuit 5, the difference being the addition of a second drive circuit 30 to drive circuit 5. Accordingly, like numerals are utilized to indicate like structure.

Drive circuit 500 includes a first drive circuit 5 and a second drive circuit 30. Drive circuit 5 is identical to drive circuit 5 of apparatus 400 and 200 and is coupled in parallel to a first capacitor $C_1$.

Second drive circuit 30 includes a P type transistor 31 coupled between the cathode of diode $D_i$ at a junction J and one end of an urging coil $L_i$ at a junction K. The cathode of a diode 32 is coupled to one end of capacitor $C_2$ and the anode is coupled to transistor 31 at junction J. Transistor 31 and transistor $TR_i$ are of different polarities, transistor 32 forming a current loop for urging coil $L_i$. Diode 32 is provided to prevent a reverse current through transistor 31 from capacitor $C_2$.

Reference is now made to FIGS. 6 and 7 which illustrate the operation of drive circuit 500. FIG. 6 represents the energization states of transistors $TR_i$ and 31 as well as the current waveform (solid line) passing through urging coil $L_i$ corresponding to these energization states. The dotted lines of the current waveform passing through urging coil $L_1$ represent the current waveforms for apparatus 200 and 400. The parameters of urging coil $L_i$ is altered to allow greater amount of current flow.

With the drive circuit arranged in accordance with drive circuit 500, kinetic energy may be more rapidly transferred to the print wire. During the first half of the energization cycle, the current increases and power consumption becomes great. However, during the second half of the cycle as current substantially decreases the power consumption during a cycle can be reduced. Most of the electro-magnetic energy of urging coil $L_i$ is stored in capacitor $C_2$ when transistor 31 is turned OFF resulting in a further increase in power source efficiency.

Reference is now made specifically to FIG. 7 illustrating a different manner of operation for drive circuit 500. FIG. 7 illustrates the energization states of transistor $TR_i$ and transistor 31 and the current flowing through urging coil $L_1$. Energization of transistor $TR_i$ is substantially the same as in FIG. 6. However, energization of transistor $TR_1$ now includes providing the periodic combination of a square wave followed by a pulse train. The current flowing through urging coil $L_i$ exhibits the trapezoidal periodic waveform. Such an energizing arrangement also improves the efficiency of power source 500.

Figure 8:
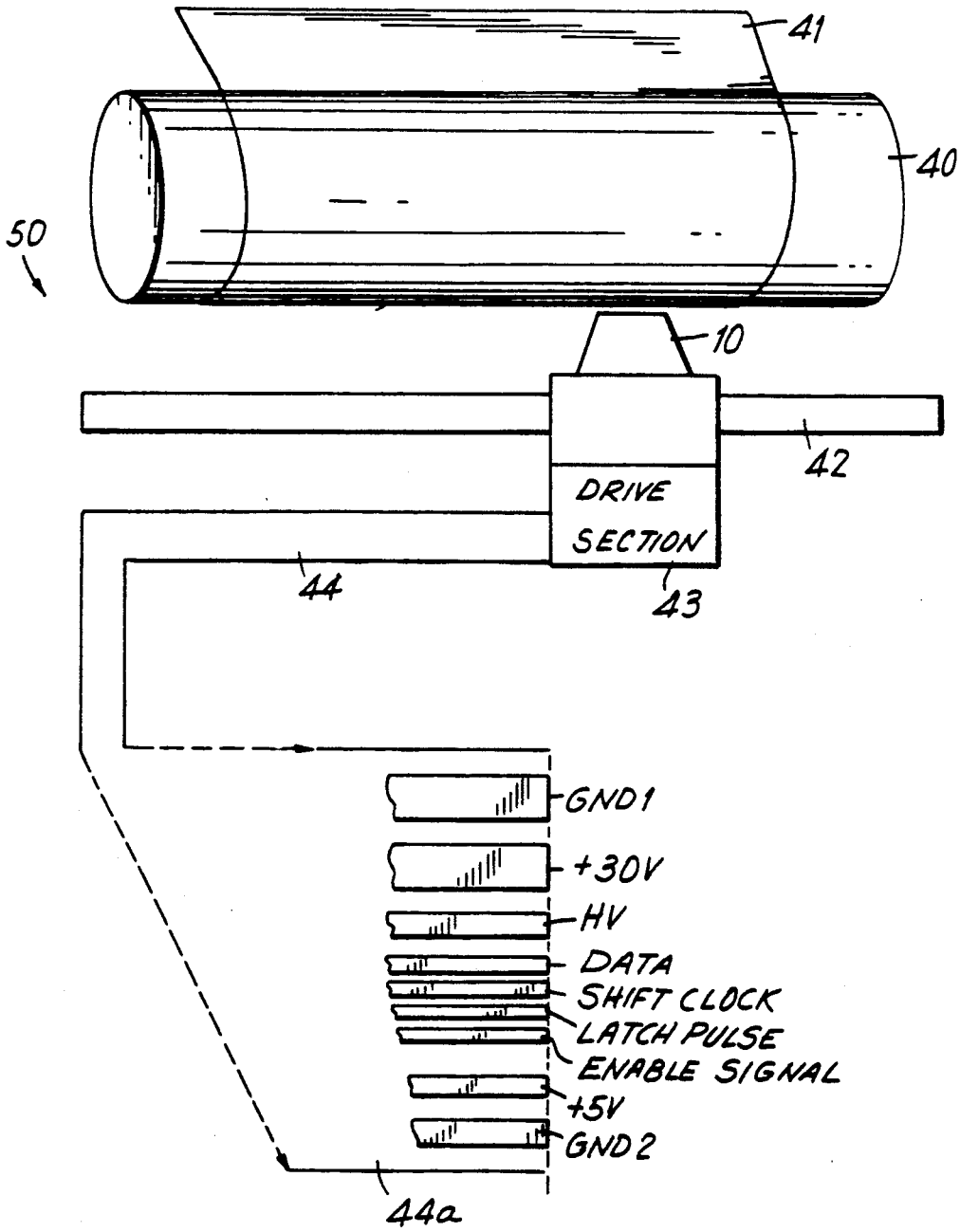
FIG. 8 is a diagram of a printer constructed in accordance with the invention.
Figure 9:
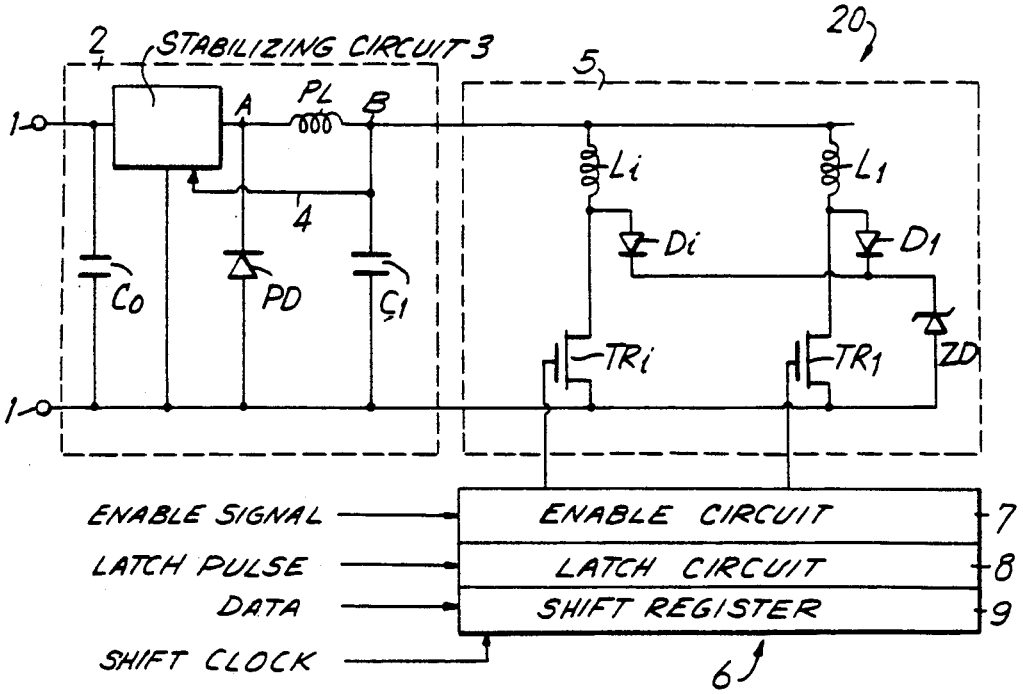
FIG. 9 PRIOR ART
FIG. 9 is a schematic diagram of an apparatus for driving a wire dot print head in accordance with the prior art.
Figure 12:
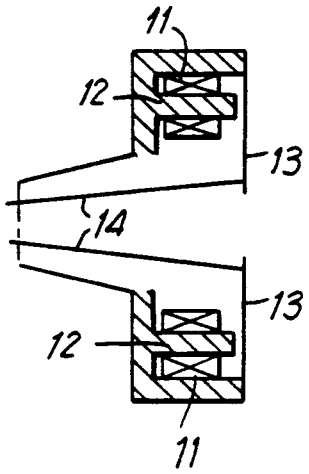
FIG. 12 PRIOR ART
FIG. 12 is a cross sectional view of wire dot print head of FIG. 9.
Figure 10A:
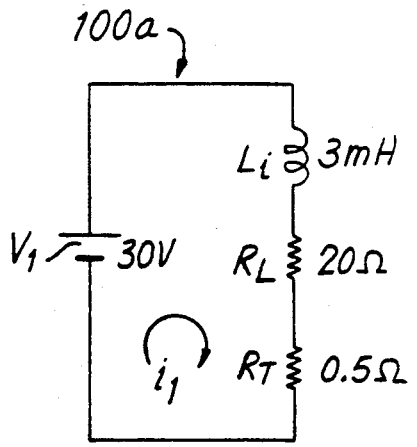
FIG. 10a PRIOR ART
FIGS. 10*a* and 10*b* are circuit diagrams of equivalent circuits of the circuit shown in FIG. 9.
Figure 10B:
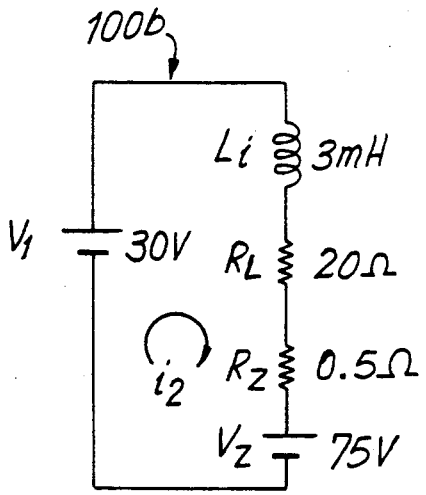
FIG. 10b PRIOR ART
Figure 11:
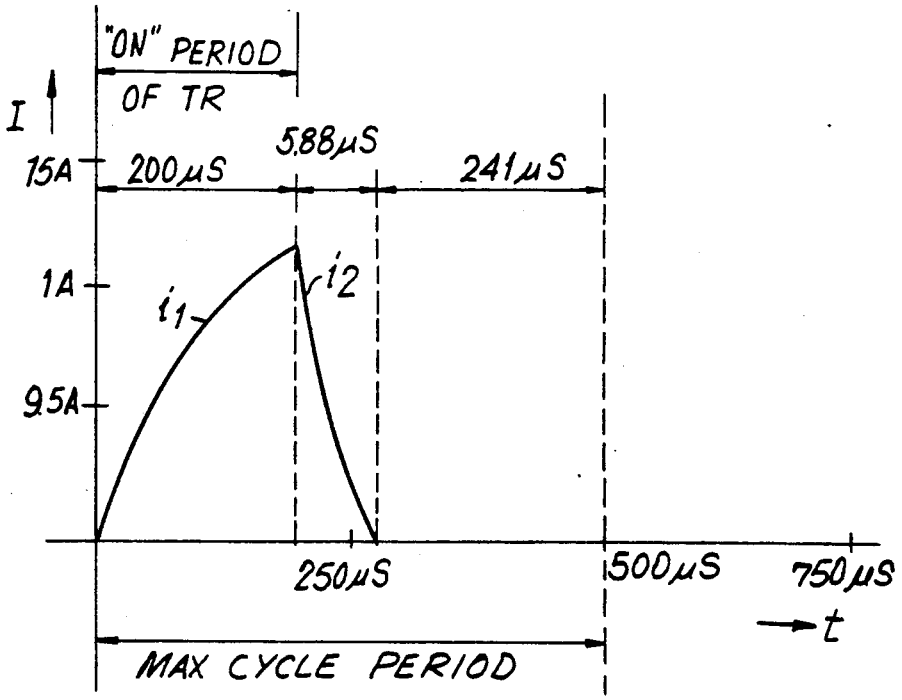
FIG. 11 is a graphical representation of the operating current flowing in the equivalents circuits of FIG. 10.

Reference is now made to FIG. 8 in which an application of the present invention to a wire dot printer is provided. A printer, generally indicated as 50 includes a platen 40 about which recording paper 41 is provided. A carriage 42 slideably supports a print head 10, recording paper 41 being disposed between print head 10 and platen 40. An ink ribbon (not shown) is disposed between recording paper 41 and print head 10. Carriage 42 is adapted to move print head 10 horizontally relative to recording paper 41. A drive section 43 includes drive circuit 5 or drive circuit 500 as well as drive signal generator 6. Drive section 43 is mounted on carriage 42 adjacent print head 10.

Mounting drive section 43 and carriage 42 makes it possible to reduce the number of cables and number of terminals required when compared with the prior art print head which connects the urging coil by means of a connecting cable. Such an arrangement also reduces production cost as the control section of the printer may be made more compact.

A connecting cable 44 connects drive section 43 to a control section of the printer. A terminal section **44*a* of connecting cable 44, shown in expanded form, connects cable 44 to the control section. In terminal section 44*a*, terminals GND 1 and 30 V represent the power supply side terminal. Terminals GND 2 and 5 V represent supply side terminals for the drive signal generator. An HV terminal connects to capacitor $C_2$. If capacitor $C_2$, the feedback loop components, and the charging power source for capacitor $C_2$ are also mounted in carriage 42**, there is no need for the HV terminal.

By temporarily accumulating the electro-magnetic energy within capacitor $C_2$ of the print wire drive apparatus after striking of the print wire and feeding back this excess energy to the power source in such a manner as to maintain capacitor $C_2$ at a fixed level, reduction in power consumption, high speed print wire response and reductions in apparatus size and cost may be obtained. By providing a first of two detection circuits for detecting whether or not the accumulated charge has reached a predetermined voltage level and at least a first switch for switching in response to such detection by the first detection circuit excess energy stored in capacitor $C_2$ may be maintained at an appropriate level and provide a highly efficient feedback loop. By providing a second detection circuit for detecting whether or not the voltage of the accumulating circuit (i.e., capacitor $C_2$) is at a second predetermined voltage level, a second switch which switches in response to the output of the second detection circuit and a predetermined clock signal the efficiency at which the voltage of the accumulating circuit is maintained is increased so that the voltage does not fall to far below the first predetermined level. By utilizing diodes within the first and second switches to effect the feedback of excess energy from the accumulating circuit to a smoothing capacitor ($C_1$) as well as maintaining the voltage within the accumulating circuit, it becomes possible to reduce the number of component elements required to provide an efficient feedback arrangement. By replacing the zener diode of the prior art with an accumulating circuit including a capacitor as much as 46% of the electro-magnetic energy is prevented from being converted into heat, increasing power conservation and efficiency. Additionally, if the voltage accumulating circuit is set to a high level it becomes possible to rapidly transmit the accumulated energy to the urging coils without increasing the amount of power consumed so that a high speed printer is easily attained.

It will thus be seen that the objects set forth above, among those made apparent from the preceding description are efficiently attained and, since certain changes may be made in carrying out the above the constructions, without departing from the spirit and scope of the invention, it is intended that all matter contained in the above description and shown in the accompanying drawings shall be interpreted as illustrative and not in a limiting sense.

It also to be understood that the following claims are intended to cover all the generic and specific features of the invention herein described and all statements of the scope of the invention which, as a matter of language, might be said to fall therebetween.

What is claimed is:

1. A print wire driving apparatus for use in a printer, the printer including at least one print wire and, an associated urging coil for driving a corresponding print wire when a current is supplied to said coil, comprising:

accumulating means for storing electro-magnetic energy accumulated in said urging coil when said current is not supplied to said urging coil;

power source means for producing said current, said power source means including a smoothing capacitor and a smoothing inductor, said electro-magnetic energy stored in said accumulating means being transmitted to said smoothing capacitor through said smoothing inductor;

feedback means for providing at least a portion of said electro-magnetic energy stored in said accumulating means to said smoothing capacitor of said power source means when the voltage across said accumulating means reaches a predetermined level, said feedback means including first detection means for detecting when the voltage across said accumulating means is greater than or equal to the predetermined level and first switch means responsive to detection by said first detection means for permitting at least a portion of the electro-magnetic energy in accordance with said accumulating means to be provided to said smoothing capacitor of said power source means, said smoothing inductor providing a current to said smoothing capacitor when the voltage across said accumulating means is below said predetermined level; and regulating means for maintaining a minimum level of voltage across said accumulating means, said minimum level being equal to or less than said predetermined level.

2. The print wire driving apparatus of claim 1, further including clock means for providing a clock signal, said first detection means including gate means responsive to said clock means for controlling the responsiveness of said first switch means to detection by said first detection means.

3. The print wire driving apparatus of claim 1, wherein said regulating means comprises second detection means for detecting when the voltage of said accumulating means is equal to or less than the minimum level and second switch means responsive to detection by said second detection means for permitting said minimum voltage to be provided to said accumulating means by said regulating means.

4. The print wire driving apparatus of claim 2, wherein said regulating means comprises second detection means for detecting when the voltage of said accumulating means is equal to or less than the minimum level and second switch means responsive to detection by said second detection means for permitting said minimum voltage to be provided to said accumulating means by said regulating means.

5. The print wire driving apparatus of claim 3, wherein said second switch means is coupled to said inductor, a first junction being formed at said coupling and further comprising a first uni-directional element disposed between said first junction and said accumulating means, said inductor being commonly operated by said first switch means and said second switch means to feedback the excess energy of said accumulating means to said smoothing capacitor as well as maintain the voltage of said accumulating means at one of said first predetermined voltage and said second predetermined voltage.

6. The print wire driving apparatus of claim 1, further comprising a print head, said print wire being mounted within said print head, a carriage said print head being mounted on said carriage, a driving means for energizing said urging coil and a drive signal generating means for producing a predetermined signal received by said driving means, causing said driving means to energize said coil, said signal generating means and driving means being mounted on said carriage.

7. The print wire driving apparatus of claim 1, wherein said accumulating means includes a capacitor.

8. The dot wire driving apparatus of claim 1, wherein said first detection means includes a comparator and wherein said first switch means includes a transistor.

9. The print wire driving apparatus of claim 3, wherein said accumulating means includes a capacitor and said second switch means includes a transistor.

10. The wire driving apparatus of claim 5, wherein said first uni-directional element and second uni-directional element each include a diode.

11. The print wire driving apparatus of claim 10, wherein said second switch means is coupled to said inductor, a second junction being formed at said coupling and further comprising a second uni-directional element disposed between said second junction and said accumulating means, said inductor being commonly operated by said first switching means and said second switching means to feed back the excess energy of said accumulating means to said smoothing capacitor as well as maintain the voltage of said accumulating means at one of said first predetermined voltage and said second predetermined voltage.

12. The print wire driving apparatus of claim 1, further comprising drive means for energizing said urging coil, said driving means including said urging coil, said urging coil being coupled to a first transistor having a first polarity and a second transistor having a second polarity opposite to said first polarity, said first transistor and second transistor being coupled to said accumulating means.

13. A print wire driving apparatus for use in a printer, the printer including at least one print wire and, an associated urging coil for driving a corresponding print wire when a current is supplied to said urging coil and power source means for producing said current, comprising:

accumulating means for storing electro-magnetic energy accumulated in said urging coil when current is not supplied to said urging coil;

feedback means for providing at least a portion of said electro-magnetic energy stored in said accumulating means to said power source means when the voltage across said accumulating means reaches a predetermined level, said feedback means including first detection means for detecting when the voltage across said accumulating means is greater than or equal to the predetermined level and first switch means responsive to detection by said first detecting means for permitting at least a portion of the electromagnetic energy stored in said accumulating means to be provided to said power source means;

regulating means for maintaining a minimum level of voltage across said accumulating means, said minimum level being equal to or less than said predetermined level;

an inductor, and said regulating means including second detection means for detecting whether the voltage of said accumulating means is equal to or less than the predetermined level and providing a second voltage signal in response thereto and second switch means for receiving said second voltage signal and a predetermined clock signal and producing an output in response thereto for maintaining said voltage level of said accumulating means at a second predetermined voltage; said second switch means and said inductor being coupled in series, a junction being formed at said coupling and the unit directional element being disposed between said junction and said accumulating means.

14. The print wire driving apparatus of claim 13, further comprising a print head, said print wire being mounted within said print head, a carriage said print head being mounted on said carriage, a driving means for energizing said urging coil and a drive signal generating means for producing a predetermined signal received by said driving means, causing said driving means to energize said coil, said signal generating means and driving means being mounted on said carriage.

* * * * *